US007714508B2

(12) United States Patent
Chung

(10) Patent No.: US 7,714,508 B2
(45) Date of Patent: May 11, 2010

(54) PLASMA DISPLAY PANEL WITH ENHANCED BUS ELECTRODE ALIGNMENT

(75) Inventor: Min Kook Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 704 days.

(21) Appl. No.: 11/278,474

(22) Filed: Apr. 3, 2006

(65) Prior Publication Data

US 2006/0255728 A1 Nov. 16, 2006
US 2009/0315460 A2 Dec. 24, 2009

(30) Foreign Application Priority Data

May 11, 2005 (KR) ..... 10-2005-0039293

(51) Int. Cl.
*H01J 17/49* (2006.01)

(52) U.S. Cl. ..... 313/582

(58) Field of Classification Search ..... 313/582–587; 445/23–25; 345/60; 315/169.1, 169.3
See application file for complete search history.

(56) References Cited

U.S. PATENT DOCUMENTS 6,156,433 A 12/2000 Hatori
6,344,714 B1 * 2/2002 Su et al. ..... 313/582
6,869,751 B1 * 3/2005 Asida et al. ..... 430/318
2002/0155390 A1 * 10/2002 Kim ..... 430/321
2003/0090204 A1 * 5/2003 Joo et al. ..... 313/582
2004/0041522 A1 3/2004 Takada
2004/0142623 A1 7/2004 Joo
2006/0038955 A1 * 2/2006 Kim et al. ..... 349/158

FOREIGN PATENT DOCUMENTS

KR 10-20030023404 3/2003

OTHER PUBLICATIONS

Office Action of Chinese Patent Office for Application No. 200610066362.6 dated Dec. 26, 2008 with English translation. (12 pages).

* cited by examiner

*Primary Examiner*—Joseph L Williams
(74) *Attorney, Agent, or Firm*—Fish & Richardson P.C.

(57) ABSTRACT

A plasma display panel is provided. The plasma display panel includes a front glass substrate, a transparent electrode formed on the front glass substrate, a black layer formed on an upper part of the transparent electrode, and a bus electrode formed on an upper part of the black layer. The width of the bus electrode is less than the width of the black layer.

20 Claims, 7 Drawing Sheets

PLASMA DISPLAY PANEL WITH ENHANCED BUS ELECTRODE ALIGNMENT

This Nonprovisional application claims priority under 35 U.S.C. § 119(a) on Patent Application No. 2005-0039293 filed in Korea on May 11, 2005 the entire contents of which are hereby incorporated by reference.

BACKGROUND OF THE INVENTION

1. Field of the Invention

This document relates to a display apparatus, and more particularly, to a plasma display apparatus.

2. Description of the Background Art

Out of display apparatuses, a plasma display apparatus generally comprises a plasma display panel and a driver for driving the plasma display panel.

The plasma display panel comprises a front panel and a rear panel which are made of soda-lime glass. Barrier ribs formed between the front panel and the rear panel form discharge cells. Each of the discharge cells is filled with an inert gas such as a He—Xe gas mixture, a He—Ne gas mixture. When the inert gas is discharged by a high frequency voltage, vacuum ultraviolet rays are generated. Vacuum ultraviolet rays excites a phosphors formed between the barrier ribs to display an image on the plasma display panel.

The front panel comprises a transparent electrode and a bus electrode. A black layer is formed between the transparent electrode and the bus electrode. The black layer is formed of an electrically conductive material such as ruthenium oxide, lead oxide, carbon series. The black layer and a black matrix formed between maintenance electrode pairs improve the contrast between the discharge cells.

Since Ag forming the bus electrode does not transmit light generated by the discharge and reflects light generated from the outside of the plasma display panel, the contrast is degraded.

The black layer capable of improving the contrast is interposed between the transparent electrode and the bus electrode to overcome the above-described problem.

The black layer performs a light blocking function for reducing reflectivity by absorbing external light generated from the outside of a front glass substrate of the front panel, and improves color purity and the contrast of the front glass substrate.

However, since the width of the related art black layer is approximately equal to the width of the bus electrode, edge curl is easily generated in an edge of the bus electrode. A poor contact occurs where the bus electrode contacts the black layer. It is difficult to uniformly accumulate wall charges within the discharge cell. Further, the black layer insufficiently performs the light blocking function and insufficiently improves the color purity and the contrast.

SUMMARY OF THE INVENTION

Accordingly, an object of the present invention is to solve at least the problems and disadvantages of the background art.

Embodiments of the present invention provide a plasma display panel capable of easily uniformly accumulating wall charge by preventing edge curl and improving contrast by reducing black luminance.

The embodiments of the present invention also provide a plasma display panel with improved contrast that can be manufactured in a simplified and less costly manner.

According to an aspect, there is provided a plasma display panel comprising a front glass substrate, a transparent electrode formed on the front glass substrate, a black layer formed on an upper part of the transparent electrode, and a bus electrode of the width less than the width of the black layer formed on an upper part of the black layer.

According to another aspect, there is provided a plasma display panel comprising a front glass substrate, a transparent electrode formed on the front glass substrate, a black layer formed on an upper part of the transparent electrode and a non-discharge region between discharge cells, and a bus electrode of the width less than the width of the black layer formed on an upper part of the black layer on the transparent electrode.

According to still another aspect, there is provided a plasma display panel comprising a front glass substrate, a black layer formed on the front glass substrate, and a bus electrode of the width less than the width of the black layer formed on an upper part of the black layer.

In the plasma display panel according to the embodiments of the present invention, the edge curl is prevented and the wall charges uniformly are accumulated by forming the bus electrode more narrowly than the width of the black layer. Further contrast is improved by reducing black luminance.

The plasma display panel according to the embodiments of the present invention simplifies the manufacturing process and reduces the manufacturing cost.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Embodiments of the present invention will be described in a more detailed manner with reference to the drawings.

A plasma display panel according to embodiments of the present invention comprises a front glass substrate, a transparent electrode formed on the front glass substrate, a black layer formed on an upper part of the transparent electrode, and a bus electrode of the width less than the width of the black layer formed on an upper part of the black layer.

It is preferable that the bus electrode is formed in the middle of the black layer.

It is preferable that the width of the black layer ranges from 20 μm to 100 μm.

It is preferable that the width of the black layer ranges from 50 μm to 80 μm.

It is preferable that the width of the bus electrode ranges from 50% to 90% of the width of the black layer.

It is preferable that the difference between the width of the black layer and the width of the bus electrode is less than 20 μm.

A plasma display panel according to the embodiments of the present invention comprises a front glass substrate, a transparent electrode formed on the front glass substrate, a black layer formed on an upper part of the transparent electrode and a non-discharge region between discharge cells, and a bus electrode of the width less than the width of the black layer formed on an upper part of the black layer on the transparent electrode.

It is preferable that the bus electrode is formed in the middle of the black layer on the transparent electrode.

It is preferable that the width of the black layer on the transparent electrode ranges from 20 μm to 100 μm.

It is preferable that the width of the black layer on the transparent electrode ranges from 50 μm to 80 μm.

It is preferable that the width of the bus electrode ranges from 50% to 90% of the width of the black layer on the transparent electrode.

It is preferable that the difference between the width of the black layer on the transparent electrode and the width of the bus electrode is less than 20 μm.

A plasma display panel according to the embodiments of the present invention comprises a front glass substrate, a black layer formed on the front glass substrate, and a bus electrode of the width less than the width of the black layer formed on an upper part of the black layer.

It is preferable that the bus electrode is formed in the middle of the black layer.

It is preferable that the width of the black layer ranges from 20 μm to 100 μm.

It is preferable that the width of the black layer ranges from 50 μm to 80 μm.

It is preferable that the width of the bus electrode ranges from 50% to 90% of the width of the black layer.

It is preferable that the difference between the width of the black layer and the width of the bus electrode is less than 20 μm.

Hereinafter, exemplary embodiments of the present invention will be described in detail with reference to the attached drawings.

Figure 1:
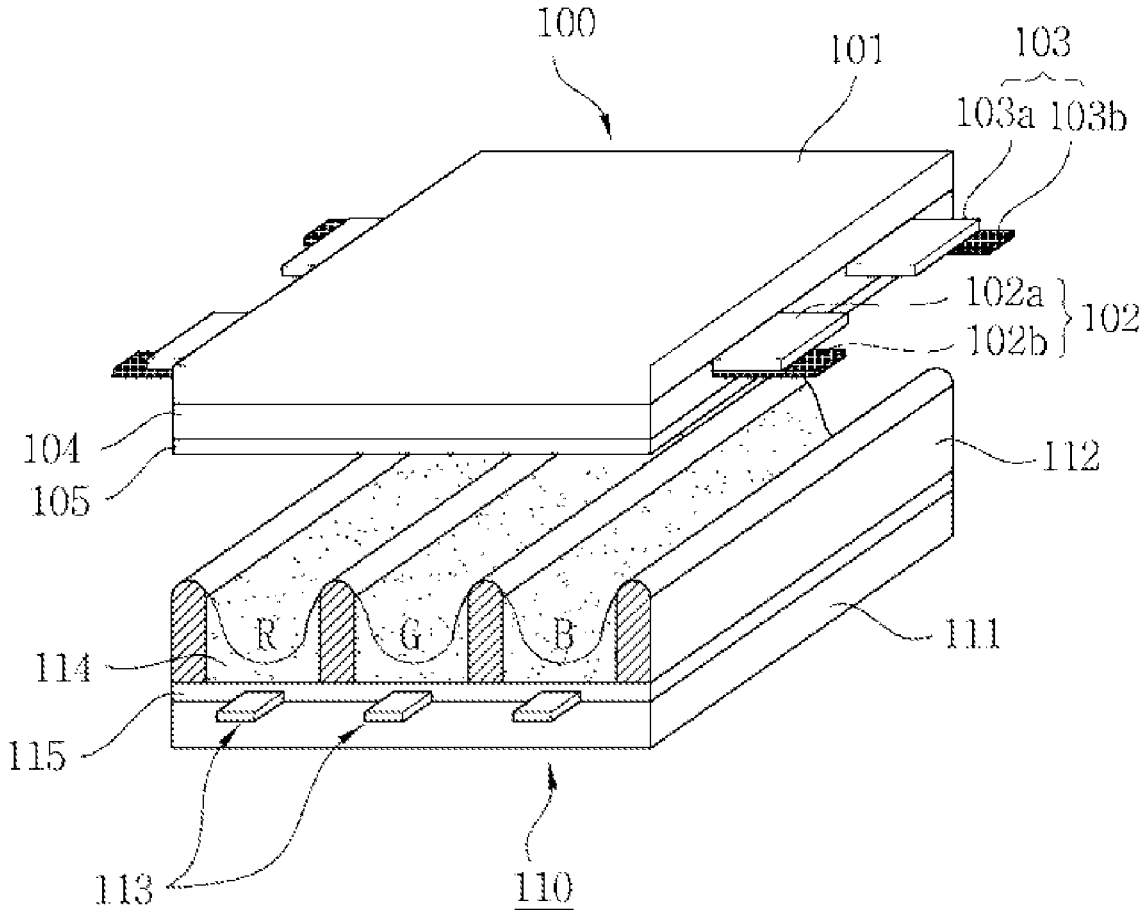
FIG. 1 shows a plasma display panel according to a first embodiment of the present invention.

FIG. 1 shows a plasma display panel according to a first embodiment of the present invention.

As shown in FIG. 1, the plasma display panel according to the first embodiment of the present invention comprises a front panel 100 and a rear panel 110 which are coupled in parallel to be opposed to each other at a given distance therebetween.

A plurality of scan electrodes 102 and a plurality of sustain electrodes 103 are formed in pairs on a front glass substrate 101 of the front panel 100 to form a plurality of maintenance electrode pairs.

The scan electrode 102 and the sustain electrode 103 each comprise transparent electrodes 102*a* and 103*a* made of transparent indium-tin-oxide (ITO) material and bus electrodes 102*b* and 103*b* made of a metal material. The scan electrode 102 and the sustain electrode 103 generate a mutual discharge therebetween in one discharge cell and maintain light-emissions of discharge cells.

The scan electrode 102 and the sustain electrode 103 are covered with one or more upper dielectric layers 104 for limiting a discharge current and providing insulation between the maintenance electrode pairs. A protective layer 105 with a deposit of MgO is formed on an upper surface of the upper dielectric layer 104 to facilitate discharge conditions.

A plurality of stripe-type (or well-type) barrier ribs 112 are formed in parallel on a rear glass substrate 111 of the rear panel 110 to form a plurality of discharge spaces, that is, a plurality of discharge cells.

A plurality of address electrodes 113 are arranged in parallel with the barrier ribs 112 to perform an address discharge and generate vacuum ultraviolet rays. Red (R), green (G) and blue (B) phosphors 114 are coated an upper surface of the rear glass substrate 111 to emit visible light for displaying an image during the generation of the address discharge. A lower dielectric layer 115 is formed between the address electrodes 113 and the phosphors 114 to protect the address electrodes 113.

Figure 2:
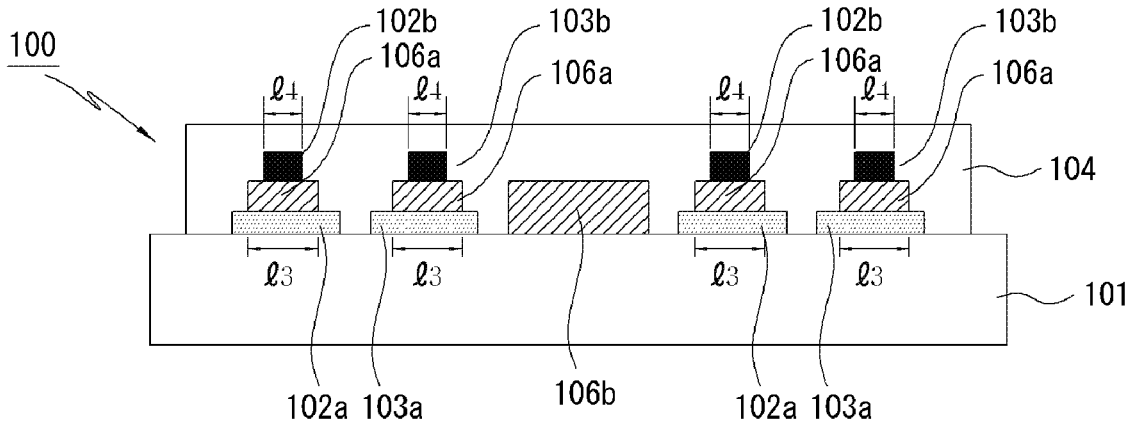
FIG. 2 is a schematic cross-sectional view of a front panel of the plasma display panel according to the first embodiment of the present invention.

FIG. 2 is a schematic cross-sectional view of a front panel of the plasma display panel according to the first embodiment of the present invention.

As shown in FIG. 2, the plurality of maintenance electrode pairs are arranged in parallel on the front glass substrate 101 of the front panel 100. The maintenance electrode pair comprise the transparent electrodes 102*a* and 103*a* made of transparent ITO material and the bus electrodes 102*b* and 103*b* made of a metal material such as Ag on the transparent electrodes 102*a* and 103*a*.

Black layers 106*a* and 106*b* made of an electrically conductive material each are formed between the transparent electrodes 102*a* and 103*a* and the bus electrodes 102*b* and 103*b* . The Black layers 106*a* and 106*b* perform a light blocking function for reducing reflectivity by absorbing external light generated from the outside of the front glass substrate 101, and improve color purity and contrast of the front glass substrate 101.

The width of the black layers 106*a* and 106*b* formed between the transparent electrodes 102*a* and 103*a* and the bus electrodes 102*b* and 103*b* is more than the width of the bus electrodes 102*b* and 103*b* formed thereon. Thus, black luminance decreases and the contrast improves.

Contrast being an important factor for evaluating the image quality of the plasma display panel is proportional to white peak and is inversely proportional to black luminance. After all, an increase in the black luminance reduces contrast. The white peak is referred to as a state of the brightest screen in an area below 10% on the basis of the area below 10% of the entire screen of the plasma display panel. The black luminance is referred to as a state in which data input is 0, that is, the luminance of the plasma display panel in its minimum luminance state.

Therefore, an increase in the area of the black layers 106*a* and 106*b* reduces the black luminance within the range capable of securing aperture ratio, and a reduction in the black luminance improves contrast.

Accordingly, the width of the black layers 106*a* and 106*b* of the plasma display panel according to the first embodiment of the present invention is more than the width of the bus electrodes 102*b* and 103*b*. For this, the width of the black layers 106*a* and 106*b* may be more than the width of the related art black layer. Or, the width of the bus electrodes 102*b* and 103*b* may be less than the width of the related art bus electrode. Or, the width of the black layers 106*a* and 106*b* may increase and the width of the bus electrodes 102*b* and 103*b* may decrease.

In FIG. 2, l3 denotes the width of the black layer 106*a*, and l4 denotes the width of the bus electrodes 102*b* and 103*b*. Since the width l4 of the bus electrodes 102*b* and 103*b* is less than the width l3 of the black layer 106*a*, the black luminance decreases by an increase in the area of the black layers 106*a* and 106*b* and contrast is improved.

Since the width of the black layers 106*a* and 106*b* formed under the bus electrodes 102*b* and 103*b* is more than the width of the bus electrodes 102*b* and 103*b*, edge curl is prevented in edges of the bus electrodes 102*b* and 103*b*.

It is preferable that the bus electrodes 102*b* and 103*b* are formed in the middle of the black layers 106*a* and 106*b*.

It is preferable that the width l3 of the black layers 106*a* and 106*b* ranges from 20 μm to 100 μm in consideration of the security of aperture ratio or resistances of the bus electrodes 102*b* and 103*b*. More preferably, the width l3 of the black layers 106*a* and 106*b* ranges from 50 μm to 80 μm.

It is preferable that the width of the bus electrodes 102*b* and 103*b* ranges from 50% to 90% of the width of the black layers 106*a* and 106*b*. When the width of the bus electrodes 102*b* and 103*b* ranges from 50% to 90% of the width of the black layers 106*a* and 106*b*, it is more preferable that a value subtracting the width of the bus electrodes 102*b* and 103*b* from the width of the black layer 106*a* and 106*b* is less than 20 μm.

Figure 3:
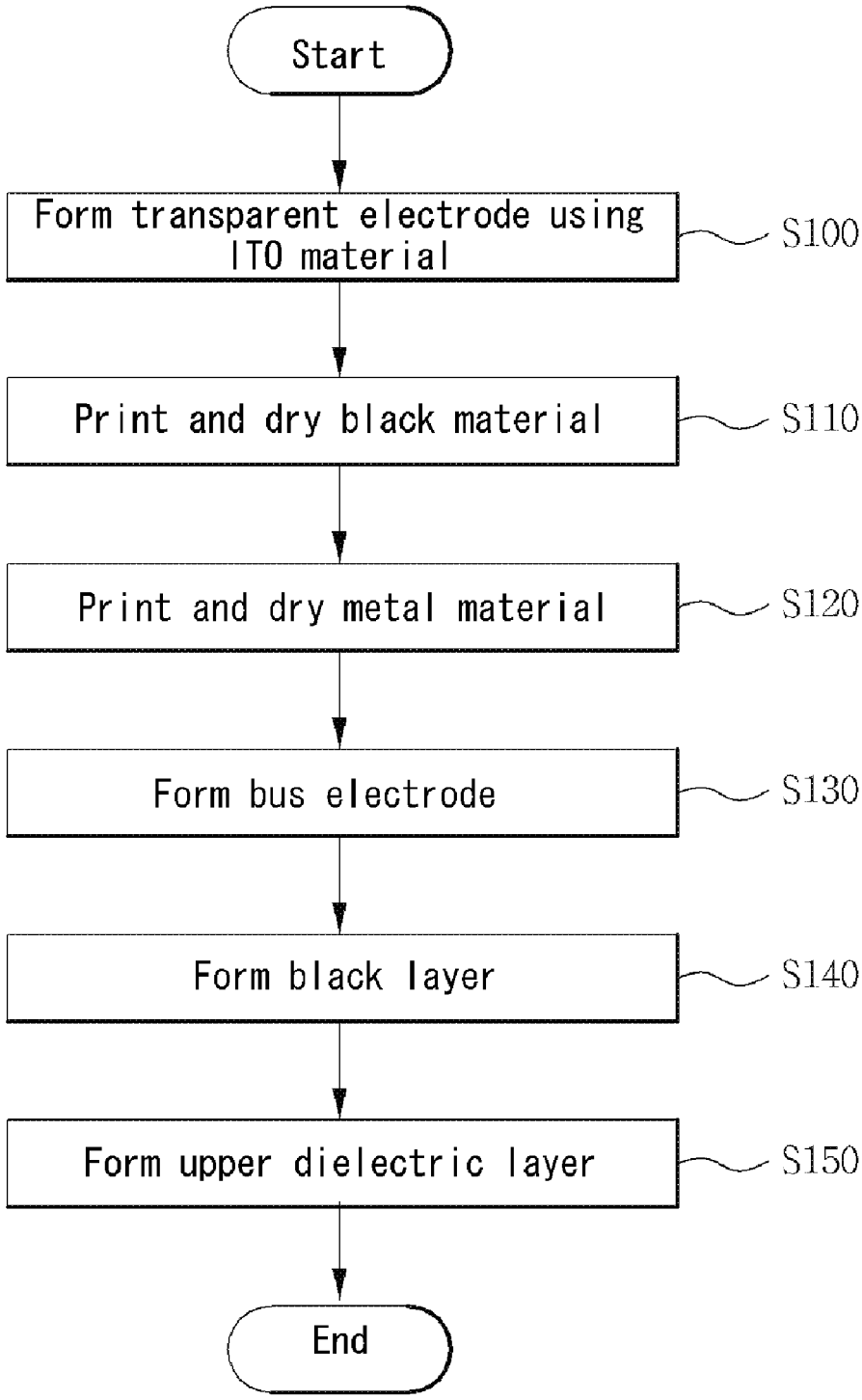
FIG. 3 is a flowchart of a method of manufacturing the front panel of the plasma display panel according to the first embodiment of the present invention.

FIG. 3 is a flowchart of a method of manufacturing the front panel of the plasma display panel according to the first embodiment of the present invention.

In step S100, ITO electrode patterns of the transparent electrodes 102*a* and 103*a* are formed on the front glass substrate 101 using ITO material.

In step S110, a black material such as a black paste is printed and dried to cover the ITO electrode patterns.

In step S120, a metal material such as a silver paste is printed and dried on an upper part of the black material.

In step S130, the metal material is exposed and developed using a first mask, thereby forming the bus electrodes 102*b* and 103*b*. Then, the bus electrodes 102*b* and 103*b* are dried and fired.

In step S140, the black material is exposed and developed using a second mask, and then the black layers 106*a* and 106*b* of the width more than the width of the bus electrodes 102*b* and 103*b* are formed on lower parts of the bus electrodes 102*b* and 103*b*.

In step S150, a dielectric material is printed and dried on an upper part of the front glass substrate 101 to cover the transparent electrodes 102*a* and 103*a*, the black layer 106*a*, the bus electrodes 102*b* and 103*b* and the black layer 106*b* protruded from the front glass substrate 101. Then, the upper dielectric layer 104 is formed.

The first mask and the second mask are used to manufacture the plasma display panel in FIG. 3. However, an additional mask may be used to manufacture the plasma display panel.

Figure 4:
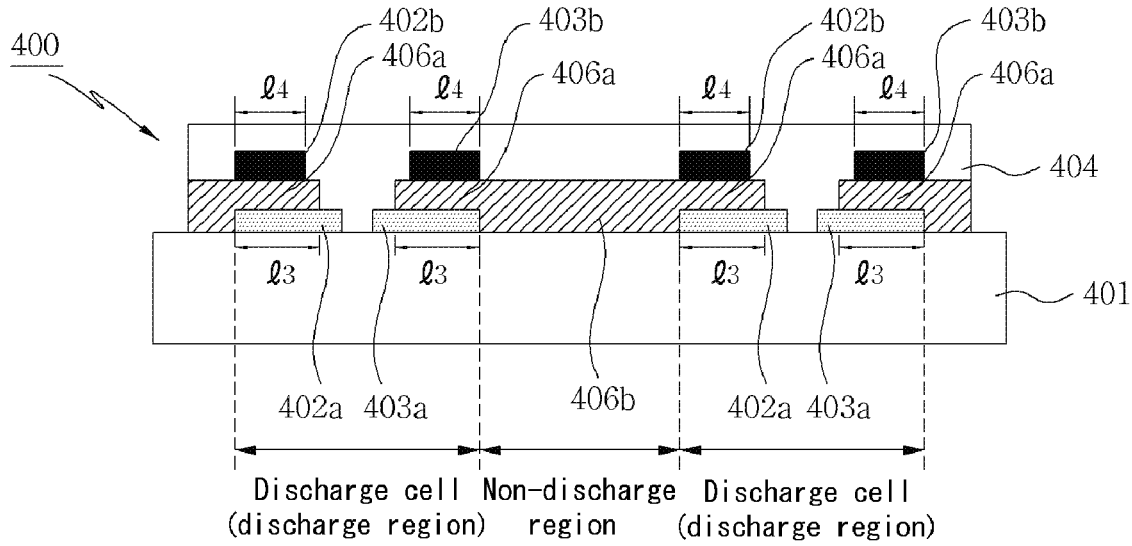
FIG. 4 is a schematic cross-sectional view of a front panel of a plasma display panel according to a second embodiment of the present invention.

FIG. 4 is a schematic cross-sectional view of a front panel of a plasma display panel according to a second embodiment of the present invention.

As shown in FIG. 4, a plurality of maintenance electrode pairs are arranged in parallel on a front glass substrate 401 of a front panel 400. The maintenance electrode pair comprise transparent electrodes 402*a* and 403*a* made of ITO material and bus electrodes 402*b* and 403*b* made of a metal material such as Ag on the transparent electrodes 402*a* and 403*a*.

Black layers 406*a* and 406*b* made of an electrically conductive material each are formed between the transparent electrodes 402*a* and 403*a* and the bus electrodes 402*b* and 403*b*.

The Black layer 406*a* and 406*b* are formed to be extended from a non-discharge region between discharge cells to a region between the transparent electrodes 402*a* and 403*a* and the bus electrodes 402*b* and 403*b* of a discharge cell adjacent to the non-discharge region. The Black layers 406*a* and 406*b* perform a light blocking function for reducing reflectivity by absorbing external light generated from the outside of the front glass substrate 401, and improve color purity and contrast of the front glass substrate 401.

Unlike the front panel 100 according to the first embodiment of the present invention, the Black layers 406*a* and 406*b* according to the second embodiment of the present invention are formed by a single process. Accordingly, a manufacturing process of the front panel 400 is simpler than the front panel 100, thereby reducing the manufacturing cost of the plasma display panel.

A width l3 of the black layer 406*a* on the transparent electrodes 402*a* and 403*a* is more than a width l4 of the bus electrodes 402*b* and 403*b* on the black layer 406*a*. Thus, black luminance is reduced and contrast is improved by a reduction in the black luminance.

Contrast being an important factor for evaluating the image quality of the plasma display panel is proportional to white peak and is inversely proportional to black luminance. After all, an increase in the black luminance reduces contrast.

Therefore, an increase in the area of the black layer 406*a* reduces the black luminance within the range capable of securing aperture ratio, and a reduction in the black luminance improves contrast.

Accordingly, the width l3 of the black layer 406*a* on the transparent electrodes 402*a* and 403*a* in the plasma display panel according to the second embodiment of the present invention is more than the width l4 of the bus electrodes 402*b* and 403*b* thereon. For this, the width l3 of the black layer 406*a* may be more than the width of the related art black layer. Or, the width l4 of the bus electrodes 402*b* and 403*b* may be less than the width of the related art bus electrode. Or, the width l3 of the black layer 406*a* may increase and the width l4 of the bus electrodes 102*b* and 103*b* may decrease.

As described above, since the width l4 of the bus electrodes 402*b* and 403*b* is less than the width l3 of the black layer 406*a* on the transparent electrodes 402*a* and 403*a*, the black luminance decreases by an increase in the area of the black layer 406*a* and contrast is improved.

Since the width of the black layer 406*a* on the transparent electrodes 402*a* and 403*a* is more than the width of the bus electrodes 402*b* and 403*b*, edge curl is prevented in edges of the bus electrodes 402*b* and 403*b*.

It is preferable that the bus electrodes 402*b* and 403*b* are formed in the middle of the black layer 406*a* on the transparent electrodes 402*a* and 403*a*.

It is preferable that the width 3 of the black layer 406*a* on the transparent electrodes 402*a* and 403*a* ranges from 20 μm to 100 μm in consideration of the security of aperture ratio or resistances of the bus electrodes 402*b* and 403*b*. More preferably, the width l3 of the black layer 406*a* on the transparent electrodes 402*a* and 403*a* ranges from 50 μm to 80 μm.

It is preferable that the width of the bus electrodes 402*b* and 403*b* ranges from 50% to 90% of the width of the black layer 406*a* on the transparent electrodes 402*a* and 403*a*. When the width of the bus electrodes 402*b* and 403*b* ranges from 50% to 90% of the width of the black layer 406*a*, it is more preferable that a value subtracting the width of the bus electrodes 402*b* and 403*b* from the width of the black layer 406*a* on the transparent electrodes 402*a* and 403*a* is less than 20 μm.

FIGS. 5*a* through 5*e* are cross-sectional views sequentially illustrating each of stages in a method of manufacturing the front panel of the plasma display panel according to the second embodiment of the present invention.

Figure 5A:
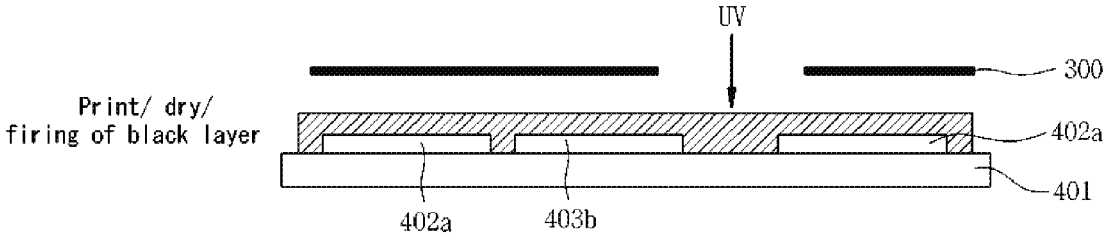
FIGS. 5*a* through 5*e* are cross-sectional views sequentially illustrating each of stages in a method of manufacturing the front panel of the plasma display panel according to the second embodiment of the present invention.

As shown in FIG. 5*a*, ITO electrode patterns of the transparent electrodes 402*a* and 403*a* are formed on the front glass substrate 401 using ITO material. Next, a black material such as a black paste for forming the black layers 406*a* and 406*b* is printed and dried, and then formation portions of the black layers 406 and 406*b* shown in FIG. 4 are exposed using a first mask.

Figure 5B:
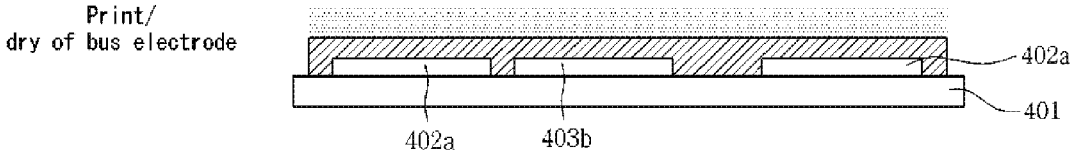

As shown in FIG. 5*b*, a metal material such as a silver paste for forming the bus electrodes 402*b* and 403*b* is printed and dried on the black material.

Figure 5C:
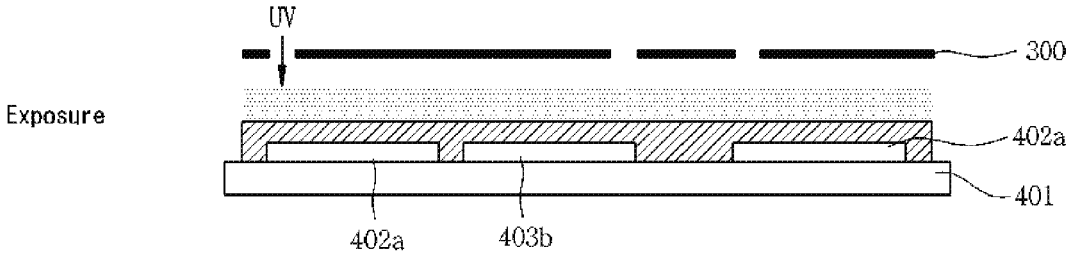
Figure 5D:
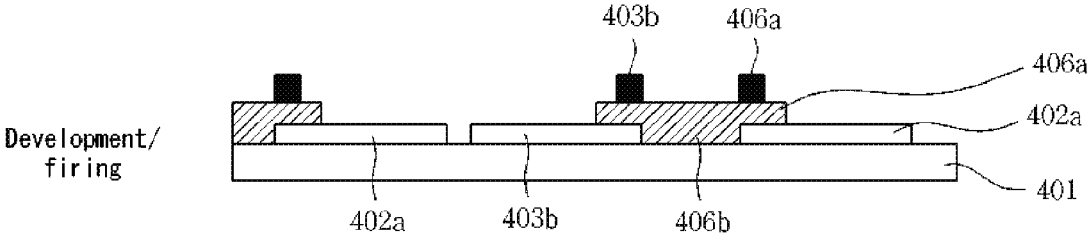

As shown in FIGS. 5*c* and 5*d*, formation portions of the bus electrodes 402*b* and 403*b* are exposed and developed by ultraviolet rays using a second mask, and then are fired using a firing furnace (not shown).

Figure 5E:
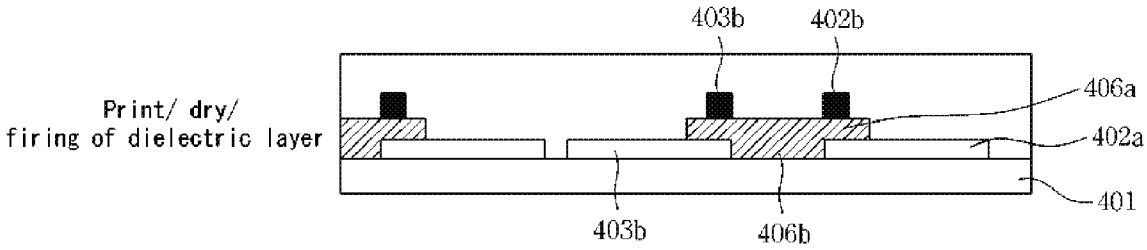

As shown in FIG. 5*e*, a dielectric paste is printed and dried. Then, the dielectric paste is fired.

The first mask and the second mask are used to manufacture the plasma display panel in FIG. 5. However, an additional mask may be used to manufacture the plasma display panel.

Figure 6:
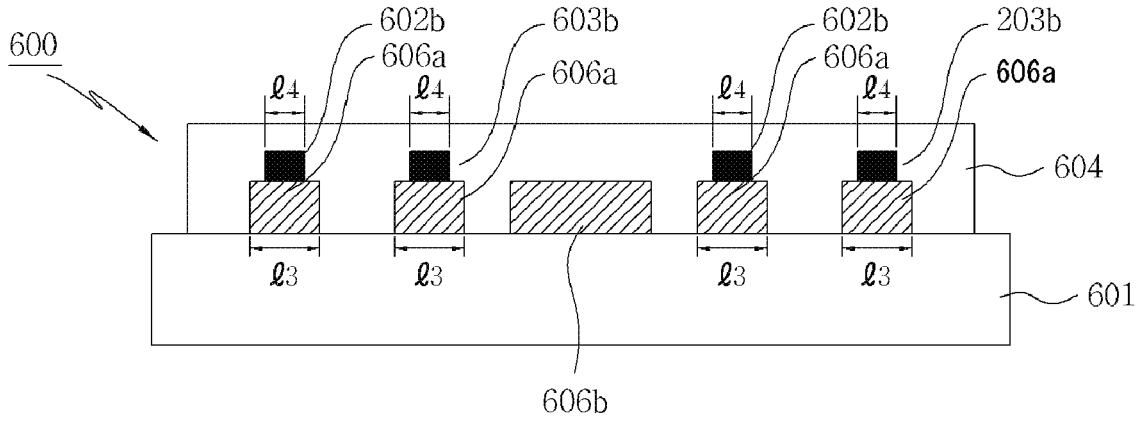
FIG. 6 is a schematic cross-sectional view of a front panel of a plasma display panel according to a third embodiment of the present invention.

FIG. 6 is a schematic cross-sectional view of a front panel of a plasma display panel according to a third embodiment of the present invention.

As shown in FIG. 6, a plurality of maintenance electrode pairs comprising bus electrodes 602*b* and 603*b* made of a metal material such as Ag are arranged in parallel on a front glass substrate 601 of a front panel 600.

Since an expensive transparent electrode is not formed on the front panel 600 of the plasma display panel according to the third embodiment of the present invention unlike the front panel 100 of the plasma display panel according to the first embodiment of the present invention, the manufacturing cost of the plasma display panel decreases.

Black layers 606*a* and 606*b* made of an electrically conductive material are formed on the front glass substrate 601 of the front panel 600. The Black layers 606*a* and 606*b* perform a light blocking function for reducing reflectivity by absorbing external light generated from the outside of the front glass substrate 601, and improve color purity and contrast of the front glass substrate 601.

The width of the black layers 606*a* and 606*b* under the bus electrodes 602*b* and 603*b* is more than the width of the bus electrodes 602*b* and 603*b* . Thus, black luminance is reduced and contrast is improved by a reduction in the black luminance.

Contrast being an important factor for evaluating the image quality of the plasma display panel is proportional to white peak and is inversely proportional to black luminance. After all, an increase in the black luminance reduces contrast.

Therefore, an increase in the areas of the black layers 606*a* and 606*b* reduces the black luminance within the range capable of securing aperture ratio, and a reduction in the black luminance improves contrast.

Accordingly, the width of the black layers 606*a* and 606*b* in the plasma display panel according to the third embodiment of the present invention is more than the width of the bus electrodes 602*b* and 603*b* thereon. For this, the width of the black layer 606*a* and 606*b* may be more than the width of the related art black layer. Or, the width of the bus electrodes 602*b* and 603*b* may be less than the width of the related art bus electrode. Or, the width of the black layers 606*a* and 606*b* may increase and the width of the bus electrodes 602*b* and 603*b* may decrease.

In FIG. 6, l3 denotes the width of the black layers 606*a* and 606*b*, and 4 denotes the width of the bus electrodes 602*b* and 603*b*. Since the width l4 of the bus electrodes 602*b* and 603*b* is less than the width l3 of the black layer 606*a* and 606*b*, the black luminance decreases by an increase in the area of the black layers 606*a* and 606*b* and contrast is improved.

Since the width of the black layers 606*a* and 606*b* formed under the bus electrodes 602*b* and 603*b* is more than the width of the bus electrodes 402*b* and 403*b*, edge curl is prevented in edges of the bus electrodes 602*b* and 603*b*.

It is preferable that the bus electrodes 602*b* and 603*b* are formed in the middle of the black layers 606*a* and 606*b*.

It is preferable that the width l3 of the black layers 606*a* and 606*b* ranges from 20 μm to 100 μm in consideration of the security of aperture ratio or resistances of the bus electrodes 602*b* and 603*b*. More preferably, the width l3 of the black layers 606*a* and 606*b* ranges from 50 μm to 80 μm.

It is preferable that the width of the bus electrodes 602*b* and 603*b* ranges from 50% to 90% of the width of the black layers 606*a* and 606*b*. When the width of the bus electrodes 602*b* and 603*b* ranges from 50% to 90% of the width of the black layers 606*a* and 606*b*, it is more preferable that a value subtracting the width of the bus electrodes 602*b* and 603*b* from the width of the black layers 606*a* and 606*b* is less than 20 μm.

As described above, since the width of the bus electrode is less than the width of the black layer in the embodiments of the present invention, the edge curl is prevented and wall charges are uniformly accumulated. Further, contrast is improved by reducing black luminance.

Moreover, a manufacturing process of the plasma display panel according to the embodiments of the present invention is simple, and thus the manufacturing cost of the plasma display panel decreases.

The invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel comprising:

a front glass substrate;

a transparent electrode formed on the front glass substrate;

a black layer formed on an upper part of the transparent electrode; and a bus electrode of the width less than the width of the black layer formed on an upper part of the black layer, wherein:

neither side edge of the bus electrode aligns with a side edge of the black layer, and the black layer is centered over the middle of the transparent electrode.

2. The plasma display panel of claim 1, wherein the bus electrode is centered over the middle of the black layer.

3. The plasma display panel of claim 1, wherein the width of the black layer ranges from 20 μm to 100 μm.

4. The plasma display panel of claim 3, wherein the width of the black layer ranges from 50 μto 80 μm.

5. The plasma display panel of claim 1, wherein the width of the bus electrode ranges from 50% to 90% of the width of the black layer.

6. The plasma display panel of claim 5, wherein the difference between the width of the black layer and the width of the bus electrode is less than 20 μm.

7. A plasma display panel comprising:

a front glass substrate;

a black layer formed directly on the front glass substrate; and a bus electrode of the width less than the width of the black layer formed on an upper part of the black layer, wherein neither side edge of the bus electrode aligns with a side edge of the black layer.

8. The plasma display panel of claim 7, wherein the bus electrode is centered over the middle of the black layer.

9. The plasma display panel of claim 7, wherein the width of the black layer ranges from 20 μm to 100 μm.

10. The plasma display panel of claim 9, wherein the width of the black layer ranges from 50 μm to 80 μm.

11. The plasma display panel of claim 7, wherein the width of the bus electrode ranges from 50% to 90% of the width of the black layer.

12. The plasma display panel of claim 11, wherein the difference between the width of the black layer and the width of the bus electrode is less than 20 μm.

13. A method comprising:

forming a transparent electrode on a front glass substrate;

forming a black layer on an upper part of the transparent electrode;

forming a bus electrode of the width less than the width of the black layer on an upper part of the black layer;

aligning the bus electrode, such that neither side edge of the bus electrode aligns with a side edge of the black layer; and centering the black layer in the middle of the transparent electrode.

14. The method of claim 13, wherein the bus electrode is centered over the middle of the black layer.

15. The method of claim 13, wherein the width of the black layer ranges from 20 μm to 80 μm.

16. The method of claim 13, wherein the width of the black layer ranges from 50 μm to 80 μm.

17. The method of claim 13, wherein the width of the bus electrode ranges from 50% to 90% of the width of the black layer.

18. The method of claim 13, wherein the difference between the width of the black layer and the width of the bus electrode is less than 20 μm.

19. The plasma display panel of claim 7, wherein the black layer is centered over the middle of the transparent electrode.

20. A plasma display panel comprising:

a front glass substrate;

at least two, separate transparent electrodes formed on the front glass substrate;

a continuous black layer formed on an upper part of each of the at least two transparent electrodes and on a non-discharge region on the front glass substrate between the at least two transparent electrodes;

a first bus electrode of a width less than the width of the black layer formed on an upper part of the black layer and within both side edges of one of the at least two transparent electrodes; and a second bus electrode of a width less than the width of the black layer formed on an upper part of the black layer and within both side edges of another of the at least two transparent electrodes, wherein neither side edge of each of the first and the second bus electrodes aligns with a side edge of the black layer.

* * * * *